United States Patent [19]

Smith et al.

[11] Patent Number: 5,003,321

[45] Date of Patent: Mar. 26, 1991

[54] DUAL FREQUENCY FEED

[75] Inventors: Edward W. Smith, Lake Arrowhead, Calif.; Homer E. Bartlett, Palm Bay, Fla.

[73] Assignee: STS Enterprises, Inc., St. Louis, Mo.

[21] Appl. No.: 774,244

[22] Filed: Sep. 9, 1985

[51] Int. Cl.[5] ..... H01Q 13/06; H01Q 15/14; H01P 1/16

[52] U.S. Cl. ..... 343/781 R; 343/786; 343/756; 343/840; 333/135; 333/126; 333/137; 333/21 A

[58] Field of Search ..... 333/134–137, 333/126, 129, 21 A, 21 R; 343/786, 756, 772, 773, 781 R, 782, 840

[56] References Cited

U.S. PATENT DOCUMENTS

| | | | |
|---|---|---|---|
| 2,342,721 | 2/1944 | Boerner | 343/838 |
| 2,398,096 | 4/1946 | Katzin | 343/756 |
| 2,423,648 | 7/1947 | Hansell | 343/840 |
| 2,530,580 | 11/1950 | Lindenblad | 342/385 |
| 2,677,055 | 4/1954 | Allen | 343/786 |
| 2,736,895 | 2/1956 | Cochrane | 343/756 |
| 2,763,860 | 9/1956 | Ortusi et al. | 343/753 |
| 2,790,169 | 4/1957 | Sichak | 343/756 |
| 2,840,820 | 6/1958 | Southworth | 343/909 |
| 2,870,444 | 1/1959 | Broussaud | 343/909 |
| 2,892,982 | 6/1959 | Allen | 333/21 R |
| 2,930,039 | 3/1960 | Ruze | 343/756 |
| 2,930,040 | 3/1960 | Weil | 343/756 |
| 2,943,324 | 6/1960 | Sichak | 343/756 |
| 2,954,556 | 9/1960 | Yang | 343/727 |
| 2,954,557 | 9/1960 | Yang | 343/756 |
| 2,972,743 | 2/1961 | Svensson et al. | 343/838 |
| 2,982,961 | 5/1961 | Jones | 343/840 |
| 3,025,515 | 3/1962 | Fairbanks | 342/53 |
| 3,086,203 | 4/1963 | Hutchison | 343/786 X |
| 3,100,894 | 8/1963 | Giller et al. | 343/756 |
| 3,148,370 | 9/1964 | Bowman | 343/756 |
| 3,161,879 | 12/1964 | Hannan et al. | 343/756 X |
| 3,165,749 | 1/1965 | Cushner | 343/911 |
| 3,195,137 | 7/1965 | Jakes, Jr. | 343/756 |
| 3,218,643 | 11/1965 | Hannan et al. | 343/756 |
| 3,231,892 | 1/1966 | Matson et al. | 343/775 |
| 3,235,870 | 2/1966 | Hannan | 343/756 |
| 3,238,529 | 3/1966 | Bock | 343/756 X |
| 3,265,993 | 8/1966 | Davidson et al. | 333/21 R X |
| 3,267,477 | 8/1966 | Brickey | 343/756 |
| 3,271,771 | 9/1966 | Hannan et al. | 343/756 |
| 3,281,850 | 10/1966 | Hannan | 343/756 |
| 3,325,817 | 6/1967 | Ajioka et al. | 343/786 |
| 3,389,394 | 6/1968 | Lewis | 343/725 |
| 3,394,378 | 7/1968 | Williams et al. | 343/779 |
| 3,438,041 | 4/1969 | Holtum, Jr. | 343/779 |
| 3,500,419 | 3/1970 | Leitner et al. | 333/126 X |
| 3,553,707 | 1/1971 | Yong et al. | 343/781 R |
| 3,594,804 | 7/1971 | Hersch | 343/754 |
| 3,680,141 | 7/1972 | Karikomi | 343/758 |
| 3,731,236 | 5/1973 | Di Tullio et al. | 333/126 |
| 3,771,160 | 11/1973 | Laverick | 343/756 |
| 3,803,617 | 4/1974 | Fletcher et al. | 343/730 |
| 3,845,483 | 10/1974 | Soma et al. | 343/361 |

(List continued on next page.)

FOREIGN PATENT DOCUMENTS

| | | | |
|---|---|---|---|
| 2526956 | 11/1976 | Fed. Rep. of Germany | 333/21 R |
| 815178 | 6/1959 | United Kingdom | 343/756 |

*Primary Examiner*—Benny T. Lee

*Attorney, Agent, or Firm*—Rogers, Howell & Haferkamp

[57] ABSTRACT

A dual frequency feed for use with an antenna permits reception of signals in both a low frequency band and a high frequency band and is comprised of a single feed through which both signals are propagated, a high frequency probe which extends concentrically within the throat of the feed for receiving the high frequency signal, a wave guide connected to the throat of the feed including a pair of turnstile junctions with four wave guides interconnecting the turnstile junctions, and a single output port with a polarization rotation device for receiving the low frequency signal. The four interconnecting wave guides may be either co-axial cables or generally rectangular wave guides.

35 Claims, 3 Drawing Sheets

U.S. PATENT DOCUMENTS

| | | | |
|---|---|---|---|
| 3,922,621 | 11/1975 | Gruner | 333/21 R X |
| 3,938,159 | 2/1976 | Ajioka et al. | 343/756 |
| 4,017,865 | 4/1977 | Woodward | 343/781 CA |
| 4,031,538 | 6/1977 | Lundgren, Jr. | 343/781 CA |
| 4,034,378 | 7/1977 | Ohm | 343/781 CA |
| 4,077,039 | 2/1978 | Ren et al. | 343/786 |
| 4,096,483 | 6/1978 | Bui Hai et al. | 343/781 CA |
| 4,176,330 | 11/1979 | Di Tullio et al. | 333/135 X |
| 4,199,764 | 4/1980 | Williams et al. | 343/786 |
| 4,220,957 | 9/1980 | Britt | 343/756 |
| 4,228,410 | 10/1980 | Goudey et al. | 333/135 X |
| 4,258,366 | 3/1981 | Green | 343/781 R X |
| 4,260,993 | 4/1981 | Aubry et al. | 343/779 |
| 4,352,108 | 9/1982 | Milne | 343/756 |
| 4,356,494 | 10/1982 | Katagi et al. | 343/781 CA |
| 4,462,034 | 7/1984 | Betsudan et al. | 343/761 |
| 4,471,359 | 9/1984 | Howard | 343/756 |
| 4,489,331 | 12/1984 | Salvat et al. | 343/753 |
| 4,525,719 | 6/1985 | Sato et al. | 343/761 |
| 4,529,989 | 7/1985 | Dupressoir et al. | 343/761 |
| 4,554,553 | 11/1985 | Grim | 333/21 A X |

DUAL FREQUENCY FEED

BACKGROUND AND SUMMARY

The satellite television reception (TVRO) industry has mushroomed in recent years, and continues to mushroom as more and more people are learning of the vast array of television programming which is accessible to them with the installation of a TVRO earth station. Still other factors are the increasing number of products available to a consumer, and the steadily decreasing cost for such a system. A typical system includes as one of its main components an antenna which is used to collect the signals from the various satellites. As is well known in the art, there are a band of satellites in geosynchronous orbit above the equator which broadcasts television signals, and the antenna's job is to collect those signals from the specific satellite to which it is pointed. At the present time, most of these satellite television signals are broadcast in C-band, or at a frequency range of 3.7 to 4.2 GHz. However, some of the signals are being broadcast at Ku-band, or frequencies ranging from 11.7 to 12.2 GHz. Because of the many advantages offered by Ku-band, more and more programmers are switching to Ku-band, and satellites being placed in orbit are in ever-increasing numbers utilizing Ku-band. Some observers even predict that Ku-band will replace C-band entirely as the C-band satellites end their useful life and fall out of orbit and are replaced by Ku-band satellites.

To take full advantage of the programming available from the satellites presently in orbit, there is a real need for the antenna to be capable of receiving signals at both C-band and Ku-band. To complicate matters further, the signals broadcast at each band are of both horizontal and vertical polarity, so the feed should be capable of receiving and making available for selection both polarizations. Presently, with the C-band feeds well known in the industry, a single polarization rotation device is usually mounted in the feed, and it includes a probe or other signal pick-up structure which can be oriented to select either vertical or horizontal polarity. This capability is desirable to quickly change from one signal to another and thereby view the full complement of television signals broadcast by any one particular satellite. This device also makes correction for skew very easy by slightly moving the probe. However, this device requires that signals of both polarization are present in the same exit port.

The inventors herein are aware of at least two prior art dual frequency feed horns which are shown in U.S. Pat. No. 3,389,394 and U.S. Pat. No. 3,500,419. The '394, patent discloses a multiple frequency feed horn which utilizes a common input of a circular wave guide, the walls of which are used to conduct the low frequency signal to a pair of dipole antennas, and which contains a co-axially mounted dielectric horn which is used to receive the high frequency portion of the signal. This structure has a single feed for the high frequency signal, but utilizes two separate dipole antennas and two separate co-axial connectors and lines to receive the low frequency signal. Similarly, the '419 patent discloses a feed with a high frequency probe extending concentrically through the interior of a low frequency horn, but the horn has four slot apertures for low frequency signals, a pair of apertures being used for each of the two differently polarized signals. A pair of half height wave guides are attached to each pair of slot apertures and are joined in a Y configuration to provide a separate feed for each of the two polarized low frequency signals. Therefore, for the feeds of either of these prior art structures, the polarization rotation device which is presently widely used cannot be utilized, and instead separate low frequency signal pick ups would be required to pick up the two differently polarized signals broadcast at low frequency. Still another more serious problem with these two prior art feeds is that there is no easy way to adjust for skew. With the polarization rotation devices presently available, skew can be easily adjusted by merely rotating the signal pick-up structure. Instead, with the construction of these prior art feeds, the entire feed would have to be rotated.

To solve these and other problems, the inventors herein have succeeded in developing a dual frequency feed which includes a high frequency probe concentrically mounted within a low frequency feed horn, which is highly desirable as it eliminates the problems and complications with offset feeds, and which also incorporates a wave guide attached to the throat of the low frequency feed for conducting low frequency signals of both polarizations such that a polarization rotation device presently available can be mounted to the wave guide and used to select between low frequency signals of different polarizations. In a first embodiment, the wave guide achieves this by utilizing a first turnstile junction mounted adjacent the throat of the low frequency feed which branches into four substantially rectangular, off axis wave guides extending parallel to the central axis of the feed. These wave guides and the low frequency signals conducted through them are then recombined in a second turnstile junction which is coaxial with the low frequency feed, high frequency probe, and first turnstile junction, and which exits through a single circular wave guide and a pair of step transitions into a single polarization rotation device. To facilitate the mounting and stability of the high frequency probe, a collar is provided on the first turnstile junction through which the probe is inserted, the diameter of the collar and probe being matched to provide an engagement therebetween to stabilize the probe in its proper orientation.

The wave guide including the two turnstile junctions and the substantially circular input and output sections can be integrally formed by a plurality of cast aluminum pieces, with flanges formed along the edges of the cast aluminum pieces to facilitate bolting of the pieces together around the high frequency probe. A tuning element may be provided consisting of an upstanding rod axially located in the second turnstile junction to reject the unwanted low frequency modes and direct the waves into the exit guide. The step transitions at the exit portion of the guide permit the higher order modes to die out before reception by the probe of the low frequency polarization rotation device. Also, a mode ring is fitted to the mouth of the throat of the wave guide to improve the illumination pattern of the feed, as is well known in the art.

Still another feature of the present invention is the construction of the high frequency probe. Generally, the high frequency probe may be a hollow metal cylinder, such as aluminum. However, to adapt the high frequency probe for use with the same reflector as is utilized for the low frequency band, a dielectric plug is utilized to "spoil" the Ku-band beam and thereby increase the electrical aperture of the probe. This broader beam width substantially desensitizes the placement of the Ku-band probe, and helps to minimize the effect on performance from improper installation, or shifting of the position of the feed over time due to weathering, wind loading, or the like. This dielectric insert may be a cast polystyrene plug which is simply inserted within the tip of the probe.

As mentioned above, the feed of the present invention permits reception of both C-band and Ku-band signals through a single feed where the signals are co-mingled at the horn input, and where the low frequency signals of both polarization are propagated through a single wave guide to a single exit port where the low frequency signal of either polarization may be detected or picked up with the presently known polarization rotation device. This is achieved with a Ku-band probe and C-band feed which are co-axially aligned for optimum utilization of the reflector and antenna.

In a second embodiment of the present invention, the off-axis rectangular wave guides may be eliminated and replaced by co-axial cables with probes extending into the square portion of circular-to-square transitions, thereby forming cable turnstile junctions, mounted both at the throat of the feed and at the transition to the low frequency polarization rotation device. These co-axial cables have probes for receiving the signal within the cable turnstile and launching the signal at the other end. Care must be taken to maintain the length of the co-axial cables so that there is no phase imbalance or power mismatch at the output cable turnstile. However, if manufactured properly, this embodiment does provide some cost savings over the cast aluminum off-axis rectangular wave guides of the first embodiment.

In a third embodiment of the present invention, the co-axial cables are utilized, but their associated probes are inserted through the outer mode ring of the feed, and not into a cable turnstile junction connected to the throat. With the Ku-band probe inserted through the inner throat of the feed, the inner throat acts as a reciprocal dummy to excite the proper mode within the mode ring, as desired. Thus, the high frequency probe receives and detects the high frequency signal, while the four low frequency probes mounted to the outer ring receive the low frequency signal. As C-band transmission is in both vertical and horizontal polarization, the four low frequency probes are best positioned symmetrically about the circular mode ring, with the top and bottom probes thus receiving vertically polarized signals, and the right and left probes receiving horizontally polarized signals. These separately detected signals are then re-combined in a cable turnstile junction within which a second set of probes are mounted at the other ends of the co-axial cables. This embodiment may not achieve the same gain as is thought to be attainable in some of the other embodiments of the present invention, but it does benefit from a further anticipated cost reduction by eliminating the first cable turnstile as is used in the second embodiment of this invention.

In a fourth embodiment of the invention, an orthomode junction (which is essentially a turnstile junction having two of its outputs shorted) is connected through a circular-to-square transition to the throat of the feed, and the Ku-band probe band is inserted through the back of the orthomode junction and concentrically within the throat of the feed as in the other embodiments. This embodiment does provide co-mingling of both high frequency and low frequency signals at the throat of the feed, but requires two separate low frequency pick-up means at its output to detect and receive both polarizations of the low frequency signal. Thus, this embodiment does not provide the inherent advantage offered by the other embodiments of this invention in that two low frequency signal pick-up means must be used, but it does offer a simpler design and anticipated lower cost to construct than some of the other embodiments. Furthermore, this embodiment also requires rotation of the feed to adjust for skew, although its simpler construction, and anticipated lighter weight does alleviate this problem somewhat. In a broad sense, the orthomode junction which is used to terminate the wave guide, is in the same family as the turnstile junctions utilized in the other embodiments. Hence, when the term "turnstile junction" is used herein, it is meant to refer to any of these constructions.

In the foregoing description and explanation of the present invention, it has been assumed that its major application has been to the TVRO industry, and, in particular, as a feed means with an antenna having a main reflector. However, this need not necessarily be the case as the feed itself can and does function as an antenna for low gain applications. This can include applications wherein data is transmitted through spread spectrum technology. Furthermore, the frequencies mentioned herein are C-band and Ku-band. However, it is anticipated that these bands may themselves be replaced in coming years such that still higher frequency bands are utilized thereby making the feed of the present invention more suitable for direct use as an antenna by itself. Thus, the inventors herein anticipate that this invention has applications well beyond the specific embodiments and applications disclosed herein.

The foregoing has been a brief description of some of the principal advantages and features of the present invention which may be more fully understood by referring to the drawings and description of the preferred embodiment which follows.

DETAILED DESCRIPTION OF THE PREFERRED EMBODIMENT

Figure 1:
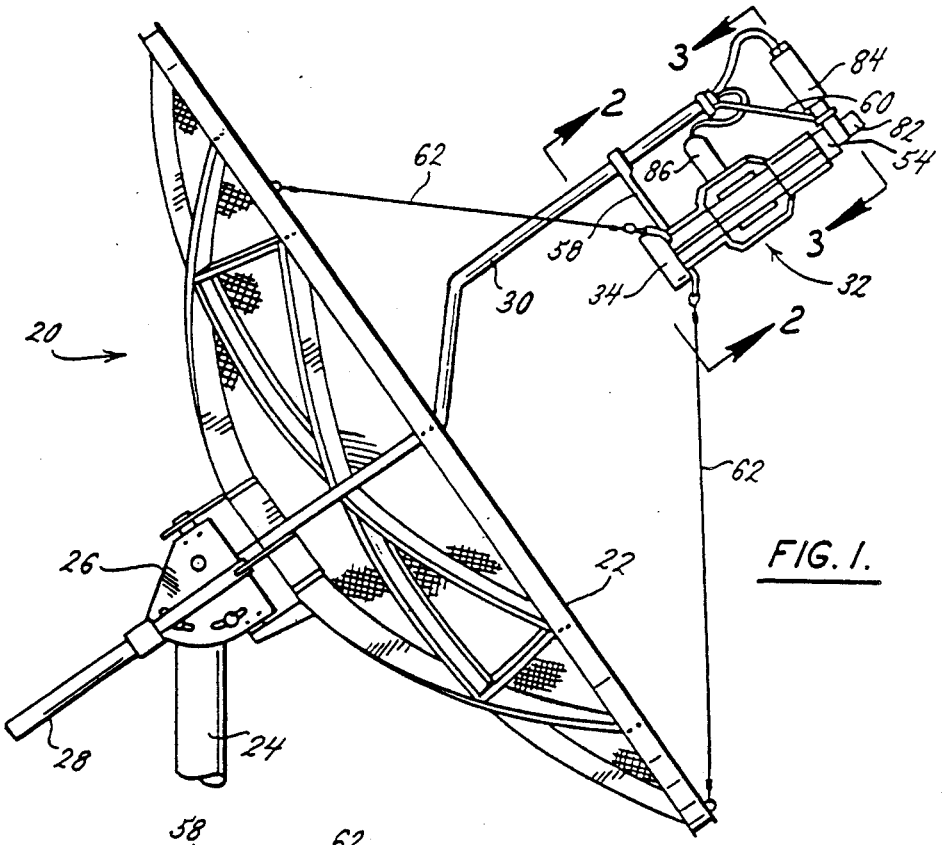
FIG. 1 is a side view of a typical prime focus TVRO antenna with the improved feed means of the present invention mounted at the focal point thereof.

An antenna 20 as might be used for a TVRO application is shown in FIG. 1 and includes a reflector 22 mounted to a mast 24 by an antenna mount 26 with a linear actuator 28 connected between the reflector 22 and the antenna mount 26 to drive the reflector 22 in the azimuth direction to facilitate pointing of the antenna 20 to any one of the group of satellites in geosynchronous orbit above the equator, as is known in the art. A button hook or mast 30 extends outwardly from the reflector 22 and provides a mounting for a feed 32 of the present invention at the electrical focal point of the reflector 22, as known in the art.

Figure 4:
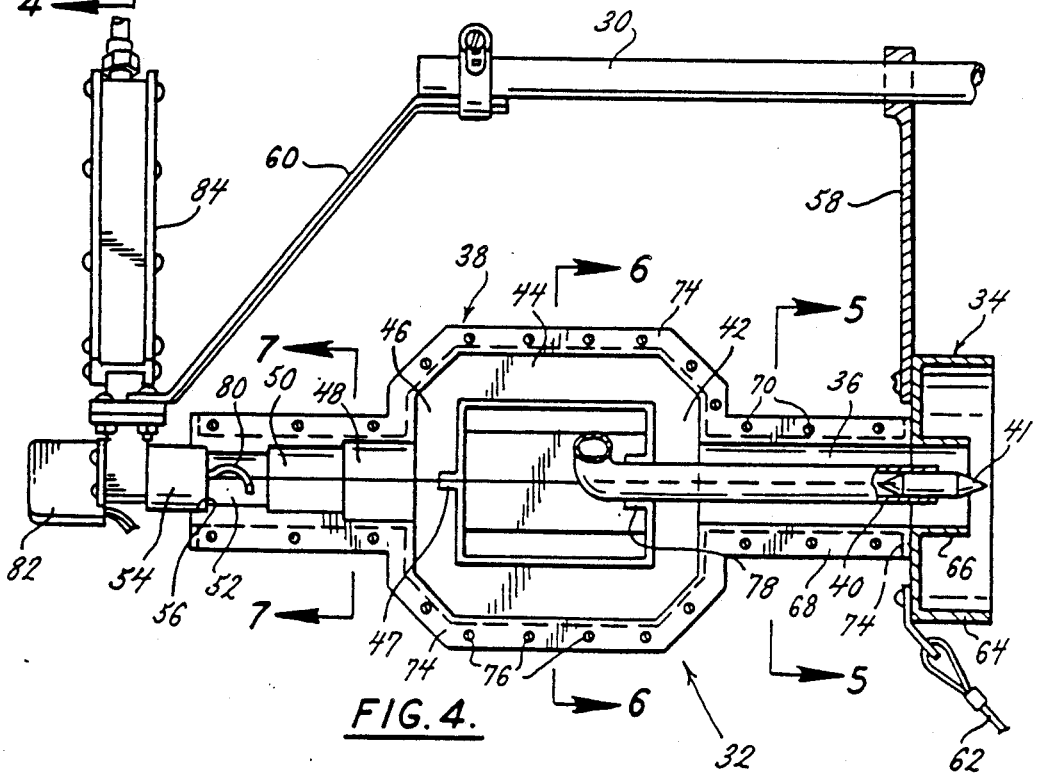
FIG. 4 is a cross-sectional view of the improved feed means taken along the plane of line 4—4 in FIG. 3.

As best shown in FIG. 4, the principal elements of the feed 32 include a mode ring 34 mounted to the throat 36 of a wave guide which is generally designated as 38. A high frequency probe 40 extends co-axially through the throat 36 and mode ring 34, as shown. A dielectric insert 41, which may be made of cast Polystyrene, is inserted into the tip of probe 40, and broadens the probe 40 beam width to facilitate its usage with reflector 22. The wave guide 38 includes a first turnstile junction 42 which branches into four rectangular wave guides 44 and then recombines in a second turnstile junction 46. A tuning element 47 is comprised of a generally cylindrical, upstanding post which extends into the second turnstile junction 46 and, as known in the art, tunes the junction 46 to reject unwanted modes and direct the signal therethrough. Two step transitions 48, 50 and formed in the circular wave guide exit portion 52, and a polarization rotation device 54 is mounted at the exit port 56, as is known in the art. A forward strut 58 and a rear strut 60 mount the feed 32 from mast 30, and a plurality of guy wires 62 may, if necessary, be mounted to the feed 32 and extend to the edge of reflector 22 (as shown in FIG. 1) to further stabilize the feed 32 to maintain it in position.

Figure 5:
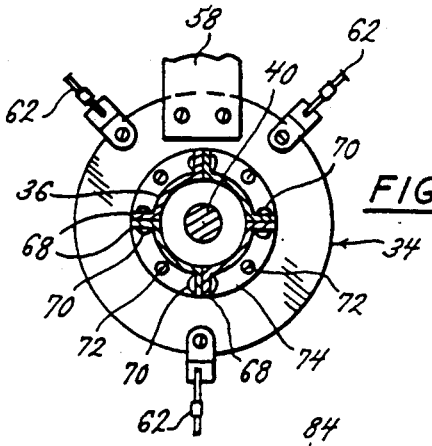
FIG. 5 is a cross-sectional view of the throat of the wave guide taken along the plane of line 5—5 in FIG. 4.
Figure 2:
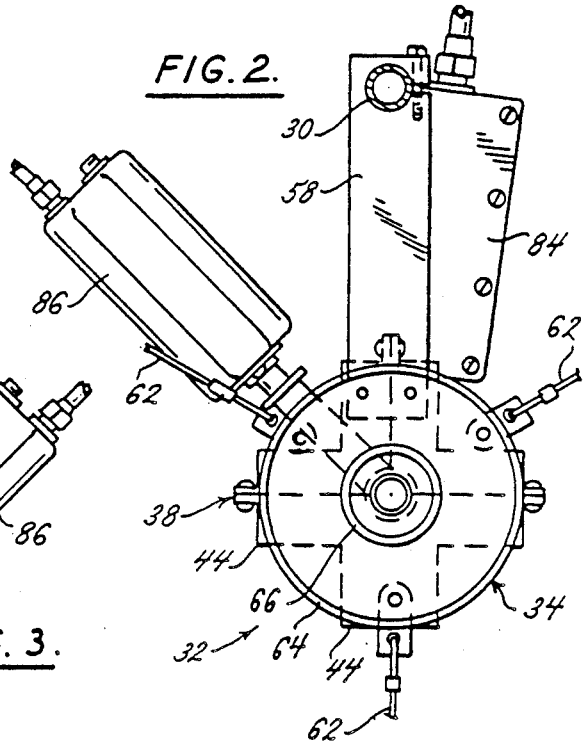
FIG. 2 is a front view of the improved feed means taken along the plane of line 2—2 in FIG. 1.

The mode ring 34 and throat 36 are shown in greater detail in FIGS. 2 and 5 wherein the mode ring includes an outer ring 64 and an inner ring 66, with an offset difference in height between them, (see FIG. 2) as is known in the art, to maximize the electrical performance thereof. The entire wave guide 38 including the throat 36, as shown in FIGS. 4 and 5 may be formed from four cast aluminum members, with flanges 68 and bolts 70 used to assemble the wave guide 38. Also, a plurality of bolts 72 extend through flange 74 to mount the mode ring 34 to throat 36.

Figure 6:
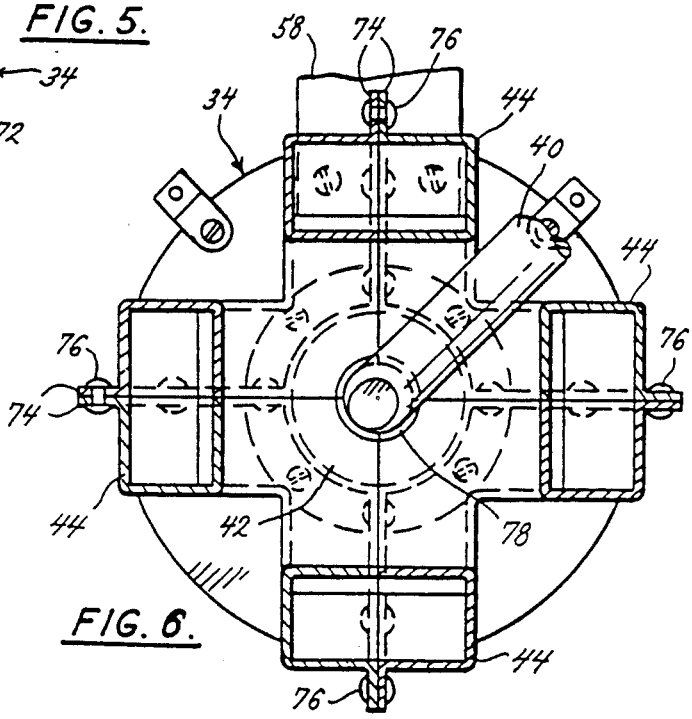
FIG. 6 is a cross-sectional view of the four substantially rectangular wave guides extending between the two turnstile junctions taken along the plane of line 6–6 in FIG. 4.

The first turnstile junction 42, rectangular wave guides 44, and high frequency probe 40 are best shown in FIG. 6. As shown therein, each wave guide 44 is a full height wave guide and is joined by flanges 74 and bolts 76. The four rectangular wave guides 44 are off-axis but symmetrically spaced about the center axis of the high frequency probe 40. Furthermore, a collar 78 is formed at the rear of the turnstile junction 42 and through which probe 40 is mounted to stabilize probe 40 and retain it in position. As is evident from FIGS. 4 and 6, the turnstile junction 42 has a single entry port through circular wave guide throat 36 and four substantially rectangular wave guide branches 44. As is known in the art, with the arrangement shown, low frequency signals of one polarization will split between opposite rectangular wave guide branches 44, such as the top and bottom branches, while the other polarization will split between the other two rectangular wave guide branches 44, such as the left and right branches. These split signals will recombine in the second turnstile junction 46 before entry into the wave guide exit portion 52, including step transitions 48, 50. This is best shown in FIG. 4.

Figure 7:
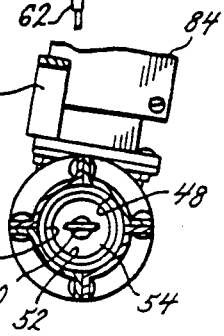
FIG. 7 is a cross-sectional view of the rear of the wave guide detailing the step transitions and polarization rotation device taken along the plane of line 7—7 in FIG. 4.
Figure 3:
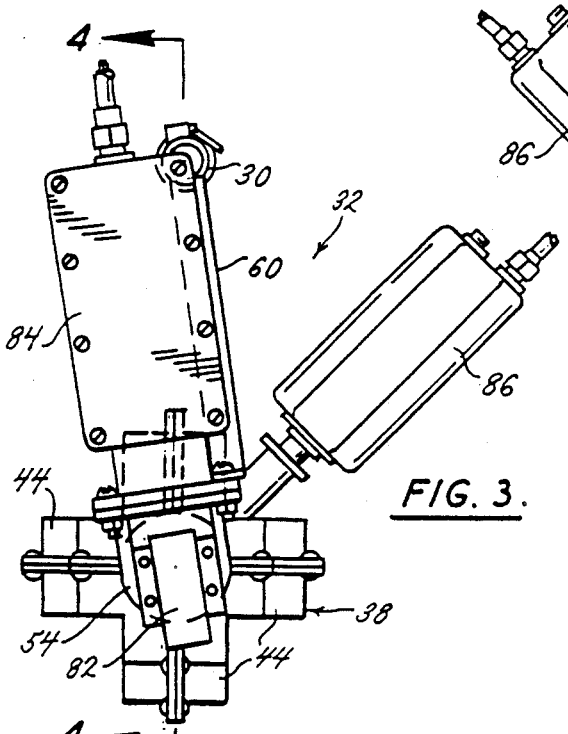
FIG. 3 is a back view of the improved feed means taken along the plane of line 3—3 in FIG. 1.

The polarization rotation device 54, as shown in FIG. 4, includes a probe 80 which is connected to a motor 82 for rotation thereof as necessary to select the signal and polarization desired to be received. Also as known in the art, the probe 80 may be slightly moved to adjust for skew as shown in FIGS. 2, 3 and 7. The received signal is launched into the low noise amplifier 84 at the low frequency end, and the high frequency signal is received and the differently polarized signals are separated in the high frequency receiver 86.

Figure 8:
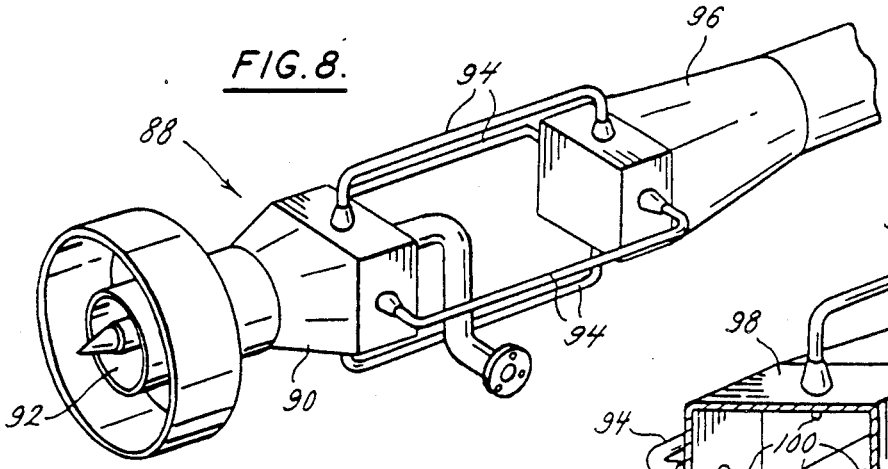
FIG. 8 is an oblique view of the second embodiment of the improved feed means of the present invention utilizing co-axial cables as a portion of the wave guide.
Figure 9:
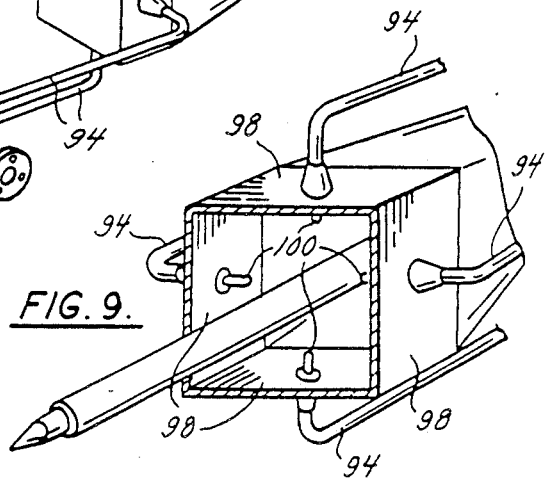
FIG. 9 is an enlarged cutaway view detailing the probes associated with the co-axial cables of the embodiments shown in FIG. 8.

A second embodiment 88 of the present invention is shown in FIGS. 8 and 9 and includes a cable turnstile junction 90 connected to the throat 92, with four co-axial cables 94 extending between transition 90 and a second cable turnstile junction 96. As detailed in FIG. 9, each co-axial cable 94 is mounted to an end wall 98 of each of junctions 90, 96, and is terminated in a probe 100 for reception or launching of the low frequency signal. As is known in the art, the vertially oriented probes 100 receive and launch the vertically polarized low frequency signal while the horizontally oriented probes 100 receive and launch the horizontally polarized low frequency signal. This second embodiment 88 thus eliminates the cast aluminum wave guide 38 of the first embodiment and replaces it with the co-axial cables 94 and cable turnstiles 90, 96.

Figure 10:
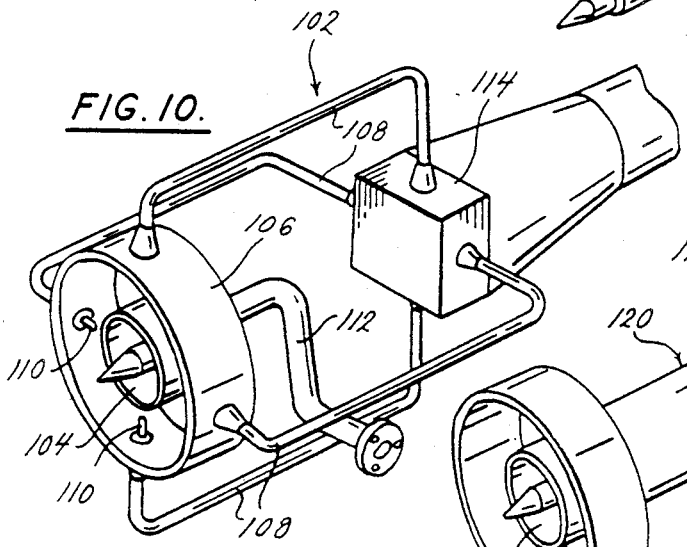
FIG. 10 is an oblique view of the third embodiment of the present invention showing direct mounting of the low frequency probes within the outer mode ring.

A third embodiment 102 is shown in FIG. 10 and includes an inner throat 104 and an outer throat 106, with four co-axial cables 108 terminating in probes 110 through the outer throat 106 to pick up the low frequency signal therein. The high frequency probe 112 extends through the inner throat 104 such that the inner throat 104 acts as a reciprocal dummy wherein there is little, if any, low frequency signal propagated. A cable turnstile junction 114 receives the other ends of the co-axial cables 108, and recombines the low frequency signals for propagation to a low frequency pick-up means (not shown). This embodiment 102 differs in operation from the first two embodiments in that the low frequency signal is only propagated in the outer throat, while the high frequency signal is only propagated in the inner throat.

Figure 11:
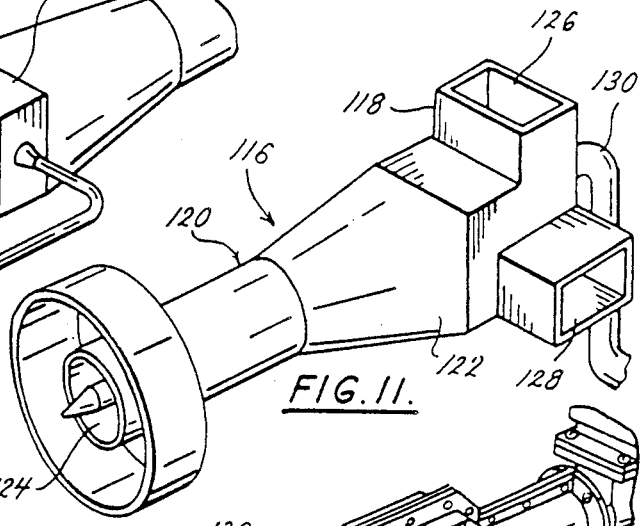
FIG. 11 is an oblique view of the fourth embodiment of the feed means of the present invention showing the use of an orthomode junction.

A fourth embodiment 116 utilizes an orthomode junction 118 as the terminating structure for the wave guide 120 comprised of a circular-to-square transition 122 connected to throat 124. This embodiment 116 differs from the previous embodiments in that a separate low frequency signal pick-up means (not shown) must be connected to each of the two output ports 126, 128 for detection of a singly polarized low frequency signal. For example, the orthomode junction 118 would propagate a vertically polarized low frequency signal through output port 126 and a horizontally polarized low frequency signal through output port 128 if installed as shown in FIG. 11. The high frequency probe 130 is inserted through the back of orthomode junction 118 and extends generally concentrically within throat 124, as shown.

Figure 12:
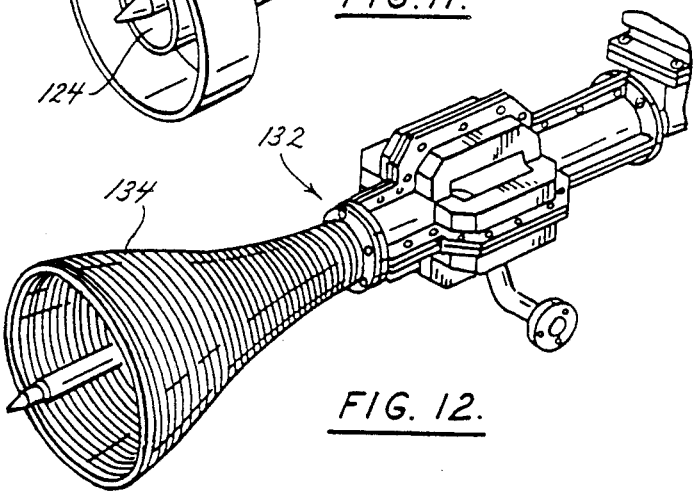
FIG. 12 is an oblique view of still another embodiment of the present invention showing the use of a corrugated S-shaped profiled horn.

Still another embodiment 132 is shown in FIG. 12 and includes generally the same structure as shown in the first embodiment, except that a corrugated profiled S-shaped horn 134 is used to detect the low frequency signal, horn 134 providing somewhat greater gain than the feeds used in the other embodiments herein. Thus, embodiment 132 might be more suitably used directly as an antenna immediately for low gain applications such as spread spectrum data transmission and reception. However, the other embodiments shown herein might be equally utilized.

There are various changes and modifications which may be made to applicants' invention as would be apparent to those skilled in the art. However, these changes or modifications are included in the teaching of applicants' disclosure, and it is intended that the invention be limited only by the scope of the claims appended hereto.

What is claimed is:

1. In an antenna for at least receiving signals broadcast from one of a group of satellites, said antenna having a main reflector dish, said dish having a predetermined shape to focus the signals from said satellite at a desired location, said satellites having means to broadcast signals in only one of either a low frequency range or a high frequency range, the improvement comprising a feed means adapted for receiving signals of both frequencies, the feed means including an inner throat, an outer throat, said throats being generally concentric, a plurality of low frequency probes extending into said outer throat for receiving the low frequency signals, a wave guide means, the wave guide means comprising a plurality of cables, each one of said cables having an end connected to an associated low frequency probe, and junction means joining the other ends of said cables, said junction means having means to combine the low frequency signals being propagated through the cables, a low frequency signal pick-up means, said junction means having a single output port for connection to the low frequency pick-up means so that all of the low frequency signals received by said feed means are propagated to a single low frequency signal pick-up means, and a high frequency probe extending generally concentrically into the inner throat.

2. The feed means of claim 1 wherein low frequency signals of two polarizations are broadcast, said junction means comprises a turnstile junction, and the plurality of low frequency probes comprises at least two probes, each probe being adapted to receive low frequency signals of only one polarization.

3. The feed means of claim 2 wherein the plurality of low frequency probes comprises four probes, two of the probes being adapted to receive low frequency signals of one polarization, and the other two probes being adapted to receive low frequency signals of the other polarization.

4. A microwave antenna for receiving signals in both a low frequency range and a high frequency range, the antenna having an inner throat, an outer throat, said throats being generally concentric, a plurality of low frequency probes extending into said outer throat for receiving the low frequency signals, a wave guide means comprising a plurality of cables, each of said cables having an end connected to an associated low frequency probe, and junction means joining the other ends of said cables, said junction means having means to combine the low frequency signals being propagated through the cables, a low frequency signal pick-up means, said junction means having a single output port for connection to the low frequency pick-up means so that all of the low frequency signals received by said feed means are propagated to a single low frequency signal pick-up means, and a high frequency probe extending generally concentrically into the inner throat.

5. A feed means for mounting to an antenna, said feed means being adapted to receive signals of both low and high frequency ranges, said feed means comprising an inner throat, an outer throat, said throats being generally concentric, a plurality of low frequency probes extending into said outer throat for receiving the low frequency signals, a wave guide means, the wave guide means comprising a plurality of cables, one of said cables having an end connected to an associated low frequency probe, a junction means joining the other ends of said cables, said junction means having means to combine the low frequency signals being propagated through the cables, a low frequency signal pick-up means, said junction means having a single output port for connection to the low frequency pick-up means so that all of the low frequency signals received by said feed means are propagated to a single low frequency signal pick-up means, and a high frequency probe extending generally concentrically into the inner throat.

6. The feed means of claim 5 wherein low frequency signals of two polarizations are broadcast, said junction means comprises a turnstile junction, and the plurality of low frequency probes comprises at least two probes, each probe being adapted to receive low frequency signals of only one polarization.

7. The feed means of claim 6 wherein the plurality of low frequency probes comprises four probes, two of the probes being adapted to receive low frequency signals of one polarization, and the other two probes being adapted to receive low frequency signals of the other polarization.

8. A microwave antenna for receiving signals in both a low frequency range and a high frequency range, said low frequency signal being comprised of signals having different polarizations, said antenna having a single throat, signals of either frequency range being propagated through the throat, a high frequency probe extending concentrically within said throat for receiving the high frequency signal, a low frequency signal pick-up means, and a wave guide means having a single input port and a single output port, the low frequency signals of all polarizations being co-mingled and propagated through at least a portion of the waveguide means, the waveguide means including a first junction proximal to the throat, the high frequency probe extending through the junction and into the throat, the waveguide means including a second junction proximal to the low frequency signal pick-up means, a plurality of waveguide members extending between said first and second junctions, the throat being connected to the input port, and the low frequency pick-up means being connected to the output port, a mode ring attached to the throat, the high frequency probe extending through the mode ring, and wherein the low frequency signal pick-up means has means to select between signals of different polarization for reception.

9. A feed means for mounting to an antenna, said feed means being adapted to receive signals of both a low frequency range and a high frequency range, said feed means comprising a single throat, a wave guide means through which the low frequency signal is propagated, a turnstile junction interconnecting the throat and the wave guide means, a high frequency probe, a dielectric plug inserted within the tip of the high frequency probe to alter the beam width thereof, means for mounting the high frequency probe through the turnstile junction and concentrically in the throat, and a single low frequency signal pick-up means connected to the wave guide means.

10. In an antenna for at least receiving signals broadcast from one of a group of satellites, said antenna having a main reflector dish, said dish having a predetermined shape to focus the signals from said one satellite at a desired location, each of said satellites having means to broadcast signals in only one of either a low frequency range or a high frequency range, the satellites broadcasting low frequency signals having means to broadcast low frequency signals of different polarizations, the improvement comprising a feed means having a single throat through which signals of either frequency range are propagated, a high frequency probe extending concentrically within said throat for receiving the high frequency signal, a low frequency signal pick-up means, and a wave guide means having a single input port and a single output port, said low frequency signals of all polarizations being co-mingled and propagated through at least a portion of the wave guide means, the wave guide means including a first turnstile junction proximal to the throat, a second turnstile junction proximal to the low frequency signal pick-up means, a plurality of wave guide members extending between said first and second junctions, and a tuning element in the second turnstile junction, the high frequency probe extending through the first turnstile and into the throat, the throat being connected to the input port, and the low frequency pick-up means being connected to the output port.

11. The feed means of claim 10 wherein the tuning element comprises an upstanding cylindrical post generally co-axial with the high frequency probe.

12. The feed means of claim 10 further comprising at least one step transition between the low frequency signal pick-up means and the wave guide means.

13. The feed means of claim 12 further comprising a mode ring attached to the throat, the high frequency probe extending through the mode ring.

14. The feed means of claim 13 wherein the low frequency signal pick-up means has means to select between signals of different polarization for reception.

15. A microwave antenna for receiving signals in both a low frequency range and a high frequency range, said antenna having a single throat, a wave guide means connected to the throat through which the low frequency signal is propagated including a circular-to-square transition, an orthomode junction, the orthomode junction being connected to the square end of said transition, the orthomode junction having two outputs, said junction having means to separately propagate low frequency signals of one polarization through one of said outputs and low frequency signals of another polarization through the other of said outputs, a separate low frequency pick up connected to each of said outputs, a high frequency probe, and means for mounting the high frequency probe through the orthomode junction and concentrically in the throat.

16. A feed means for mounting to an antenna, said feed means being adapted to receive signals of either a low frequency range or a high frequency range, said feed means comprising a single throat, a first turnstile junction, a second turnstile junction, and a wave guide means comprising a plurality of co-axial cables extending between said first and second turnstile junctions, said wave guide means having means to propagate the low frequency signal, a high frequency probe, means for mounting the high frequency probe through the first turnstile junction and concentrically in the throat, and a single low frequency signal pick-up means connected to the second turnstile junction.

17. The feed means of claim 16 wherein said plurality of co-axial cables includes four of said cables, each of said cables having a probe at each end thereof extending into its associated turnstile junction.

18. The feed means of claim 17 wherein said cables are substantially the same length.

19. The feed means of claim 18 wherein said low frequency signal is comprised of signals having different polarizations, and means to propagate low frequency signals of one polarization along two of said cables and signals of another polarization along the other two of said cables.

20. A feed means for mounting to an antenna, said feed means being adapted to receive signals of either low or high frequency ranges, said feed means comprising a single throat, said throat having means to propagate signals of either frequency, a high frequency probe extending generally concentrically within said throat for receiving the high frequency signal, a low frequency signal pick-up means, and a wave guide means having a single input port and a single output port, the throat being connected to the input port, and the low frequency pick-up means being connected to the output port, the wave guide means including a first turnstile junction proximal to the throat, a second turnstile junction proximal to the low frequency signal pick-up means, and a plurality of generally rectangular wave guides extending between said first and second turnstile junctions, the high frequency probe extending through the first turnstile junction and into the throat, the wave guides being offset from the axis defined by the high frequency probe, and a tuning element in the second turnstile junction, said tuning element comprising an upstanding generally cylindrical post, said cylindrical post being generally co-axial with the high frequency probe, and at least one step transition between the low frequency signal pick-up means and the second turnstile junction.

21. The feed means of claim 20 further comprising a collar extending outwardly from the first turnstile junction, the high frequency probe extending therethrough, the collar and the probe being dimensioned to provide mechanical support to the probe as it is mounted within the throat.

22. The feed means of claim 21 wherein the wave guide means is comprised of a plurality of cast members, said cast members having flanges to facilitate their assembly.

23. In an antenna for at least receiving signals broadcast from one of a group of satellites, said antenna having a main reflector dish, said dish having a predetermined shape to focus the signals from said satellite at a desired location, said satellites having means to broadcast signals in only one of either a low frequency range or a high frequency range, the improvement comprising a feed means having a single throat having means to propagate signals of either frequency, a mode ring mounted to the throat, a wave guide means through which the low frequency signal is propagated, a first turnstile junction interconnecting the throat and the wave guide means, a second turnstile junction, a tuning element in the second turnstile junction, the wave guide means comprising a plurality of generally rectangular wave guides extending between said first and second turnstile junctions, a high frequency probe, means for mounting said high frequency probe through the first turnstile junction and concentrically through the throat and into the mode ring, and a low frequency signal pick-up means connected to the second turnstile junction by at least one step transition.

24. The feed means of claim 23 further comprising a collar extending outwardly from the first junction, the high frequency probe extending therethrough, the collar and the probe being dimensioned to provide mechanical support to the probe.

25. The feed means of clam 24 wherein the wave guide means is comprised of a plurality of cast members, said cast members having flanges to facilitate their assembly.

26. The feed means of claim 25 wherein the wave guide means is made from aluminum.

27. The feed means of claim 26 wherein the high frequency probe, throat, first junction, second junction, and low frequency signal pick-up means are all generally co-axial to each other.

28. In an antenna for at least receiving signals broadcast from one of a group of satellites, said antenna having a main reflector dish, said dish having a predetermined shape to focus the signals from said satellite at a desired location, said satellites having means to broadcast signals in only one of either a low frequency range or a high frequency range, the improvement comprising a feed means having a single throat, a wave guide means connected to the throat through which the low frequency signal is propagated, an orthomode junction, the wave guide means including a circular-to-square transition, the orthomode junction being connected to the square end of said transition, and wherein the orthomode junction has two outputs, said junction having means to separately propagate low frequency signals of one polarization through one of said outputs and low frequency signals of another polarization through the other of said outputs, a separate low frequency pick up connected to each of said outputs, a high frequency probe, and means for mounting the high frequency probe through the orthomode junction and concentrically in the throat.

29. A feed means for mounting to an antenna, said feed means being adapted to receive signals of both low and high frequency ranges, said feed means comprising a single throat, a wave guide means connected to the throat through which the low frequency signal is propagated including a circular-to-square transition, an orthomode junction connected to the square end of the transition, the orthomode junction having two outputs, said junction having means to separately propagate low frequency signals of one polarization through one of said outputs and low frequency signals of another polarization through the other of said outputs, a high frequency probe, means for mounting the high frequency probe through the orthomode junction and concentrically in the throat, and a separate low frequency pick up connected to each of said outputs.

30. In an antenna for at least receiving signals broadcast from one of a group of satellites, said antenna having a main reflector dish, said dish having a predetermined shape to focus the signals from said satellite at a desired location, said satellites having means to broadcast signals in only one of either a low frequency range or a high frequency range, the improvement comprising a feed means having a single throat in which signals of either frequency ranges are propagated, a mode ring secured to the throat and extending outwardly therefrom, a wave guide means through which the low frequency signal is propagated comprising a first turnstile junction connected to the throat and having a collar extending outwardly therefrom, a second turnstile junction having a tuning element, and a plurality of generally rectangular wave guides extending between said first and second turnstile junctions, a low frequency signal pick-up means connected to the second turnstile junction through at least one step transition, and a high frequency probe extending through the first turnstile junction, collar, throat, and mode ring, and being generally concentric therewith, the collar and the probe being dimensioned to provide mechanical support to the probe.

31. The feed means of claim 30 wherein the wave guide means is comprised of a plurality of cast members, said cast members having flanges to facilitate their assembly, and wherein the high frequency probe, throat, first and second turnstile junctions, and the low frequency signal pick-up means are all generally co-axial to each other.

32. A feed means for mounting to an antenna, said feed means being adapted to receive signals of either a low frequency range or a high frequency range, said feed means comprising a single throat, the throat having means to propagate signals of either frequency, a mode ring mounted to the throat, a wave guide means through which the low frequency signal is propagated comprising a first turnstile junction interconnecting the throat and the wave guide means, a second turnstile junction, a tuning element in the second turnstile junction, and a plurality of generally rectangular wave guides extending between said first and second turnstile junctions, said low frequency signal pick-up means being connected to the second turnstile junction, a high frequency probe, means for mounting the high frequency probe through the first turnstile junction and concentrically in the throat and mode ring, and a single low frequency signal pick-up means connected to the wave guide means through at least one step transition.

33. The feed means of claim 32 wherein the mode ring, throat, high frequency probe, first and second turnstile junctions, and low frequency signal pick-up means are generally co-axial to each other.

34. A microwave antenna for receiving signals in both a low frequency range and a high frequency range, said antenna having a single throat where both frequencies are co-mingled, a mode ring mounted to the throat, a wave guide means through which the low frequency signal is propagated, a turnstile junction interconnecting the throat and the wave guide means, a high frequency probe with means to alter the beam width thereof comprising a dielectric plug inserted within the tip of the high frequency probe, means for mounting said high frequency probe through the turnstile junction and concentrically in the throat, a low frequency signal pick-up means connected to the wave guide means, and a second turnstile junction and a plurality of generally rectangular wave guides extending between said first and second turnstile junctions, said low frequency signal pick-up means being connected to the second turnstile junction.

35. A microwave antenna for receiving signals in both a low frequency range and a high frequency range, said antenna having a single throat in which signals of both frequency ranges are co-mingled, a mode ring secured to the throat and extending outwardly therefrom, a waveguide means through which the low frequency signal is propagated comprising a first turnstile junction connected to the throat, a second turnstile junction, and a plurality of generally rectangular waveguides extending between said first and second turnstile junctions, a low frequency signal pick-up means connected to the second turnstile junction, a high frequency probe extending through the first turnstile junction, throat, and mode ring, and being generally concentric therewith, and means to control the electrical aperture of the high frequency probe comprising a dielectric plug inserted within the tip of the high frequency probe.

* * * * *